US010681990B1

(12) United States Patent
Cutler

(10) Patent No.: US 10,681,990 B1
(45) Date of Patent: Jun. 16, 2020

(54) MATTRESS AND BOX SPRING WITH HIDDEN GUN COMPARTMENT

(71) Applicant: Leon Cutler, Jersey City, NJ (US)

(72) Inventor: Leon Cutler, Jersey City, NJ (US)

( * ) Notice: Subject to any disclaimer, the term of this patent is extended or adjusted under 35 U.S.C. 154(b) by 228 days.

(21) Appl. No.: 15/947,819

(22) Filed: Apr. 8, 2018

Related U.S. Application Data

(63) Continuation-in-part of application No. 15/056,471, filed on Feb. 29, 2016, now Pat. No. 9,949,574.

(51) Int. Cl.

| | |
|---|---|
| ***A47C 17/86*** | (2006.01) |
| ***A47C 19/02*** | (2006.01) |
| ***A47C 19/22*** | (2006.01) |
| *A47B 81/00* | (2006.01) |

(52) U.S. Cl.
CPC ..... *A47C 17/86* (2013.01); *A47C 19/025* (2013.01); *A47C 19/22* (2013.01); *A47B 81/005* (2013.01)

(58) Field of Classification Search
CPC ..... A47C 27/05; A47C 27/053; A47C 27/056; A47C 17/86; A47C 27/142; A47C 27/144; A47C 27/146; A47C 27/15; A47C 31/00; A47C 19/025; A47C 19/22; F41C 9/02; A47B 81/005; A61G 7/02
See application file for complete search history.

(56) References Cited

U.S. PATENT DOCUMENTS

| | | | | | |
|---|---|---|---|---|---|
| 229,460 | A * | 6/1880 | Prince | A61G 7/02 | 5/604 |
| 307,717 | A * | 11/1884 | Gunold | A61G 7/02 | 5/604 |
| 610,863 | A * | 9/1898 | Hummel | A61G 7/02 | 5/604 |
| 1,407,631 | A * | 2/1922 | Brown | A61G 7/02 | 5/604 |
| 5,537,701 | A * | 7/1996 | Elliott | A47C 19/005 | 5/616 |
| 5,604,021 | A * | 2/1997 | Wagner | A47C 27/146 | 428/218 |

* cited by examiner

*Primary Examiner* — Eric J Kurilla
*Assistant Examiner* — Amanda L Bailey
(74) *Attorney, Agent, or Firm* — Michael J. Feigin, Esq.; Feigin and Fridman LLC

(57) ABSTRACT

A gun holder is situated within a box spring beneath a mattress. The mattress itself has an opening therein matching the size of the opening into the gun holder and extending through the mattress. One can then lie on one's bed and near one's arm, reach downward into the box spring or other mattress support, and grab the gun without having to move the majority of one's body from the position in which one was sleeping on the bed.

12 Claims, 6 Drawing Sheets

MATTRESS AND BOX SPRING WITH HIDDEN GUN COMPARTMENT

FIELD OF THE DISCLOSED TECHNOLOGY

The disclosed technology relates generally to mattresses and, more specifically, to those with hidden compartments.

BACKGROUND OF THE DISCLOSED TECHNOLOGY

Sometimes you just can't grab your gun fast enough. Imagine a scenario where you're lying in bed and you wake to a person rummaging through your house looking for your valuables. Worse, imagine if you wake to an intruder in your room. You don't have a chance to jump out of bed, open your safe, or what have you. You may not even have a chance to move. In the prior art, some have placed drawers under beds for guns, such as in U.S. Pat. No. 6,292,960 to Bowling or U.S. Pat. No. 2,895,145 to Soifer. Still, one would have to reach out of one's bed and down to the side, then open up the side and grab the gun within. You just can't do that with a stranger already in your room, with the own gun pointed at your head.

What is required is a way to sleep safely in your bed, knowing that there is a gun accessible when you need it.

SUMMARY OF THE DISCLOSED TECHNOLOGY

A combination mattress and box spring makes up aspects of the disclosed technology. The mattress has a top, bottom, left, right, front, and back sides. The top side is the side one sleeps on, whereas the bottom side is the side facing the ground beneath ("gravitational bottom"). For purposes of this disclosure and claims, "top" and "bottom" are used throughout in a manner to be consistent, with the left, right, front, and back sides being sides between the planar, or substantially planar top and bottom sides. A mattress support further has top, bottom, left, right, front, and back sides, and is situated beneath the mattress and supports the weight of the mattress. A portal in the mattress extends from the top side to the bottom side of the mattress and has left, right, front, and back sides. These sides, for purposes of the disclosure, face in the same direction consistently. Thus, for example, a "left side" of a portal is to the same left of the portal in this cardinal direction as the left side of the mattress is on its relative left side, e.g., in the same cardinal direction.

A portal in the mattress support has a top side lined up with, and has, equal dimensions to the portal in the mattress. The portal in the mattress support has a top section terminating at the top side of the portal of the mattress support, which is wider than a lower section. In embodiments, the portal in the mattress is of equal width from the top side to the bottom side of the mattress. Both portals have left, right, front, and back sides in embodiments, but in some of these embodiments, the mattress support has a wider bottom side than a top side. This bottom side can open into a bullet trap which is a device constructed in a manner sufficient to retain a bullet fired from a handgun situated in the portal of the mattress support.

The bottom side can be adapted to, or holds, a slide of a gun and is smaller in width than a magazine of the same gun. As such, the magazine with trigger remains in the top side of the portal of the mattress support. In this manner, a trigger guard of the gun rests against a top edge of the bottom side of the portal of the mattress support. The mattress support can also be a box-spring.

A sheet covering at least the top side of the mattress, with a flap in the sheet, opens into the portal of the mattress, in embodiments of the disclosed technology.

Stated in another way, a gun holder situated within a mattress support beneath a mattress, such that the mattress support has a substantially equal width and length as the mattress and a portal, extends through the mattress and substantially aligns with the portal of the mattress support on at least four sides of each of the portal of the mattress and the portal of the mattress support, in embodiments of the disclosed technology. A bullet trap opening into a bottom side of the gun holder and adapted to stop a bullet from penetrating there-through when fired from a handgun held in the gun holder is also used in embodiments of the disclosed technology.

The gun holder has a wider upper portion and narrower lower portion, in some embodiments. A handgun, where a magazine fits only in the wider upper portion to the exclusion of the narrower lower portion, is used in embodiments of the disclosed technology.

For purposes of this disclosure, the term "substantially" is defined as "at least 95% of" the term which it modifies. Any device or aspect of the technology can "comprise" or "consist of" the item it modifies, whether explicitly written as such or otherwise. When the term "or" is used, it creates a group which has within either term being connected by the conjunction as well as both terms being connected by the conjunction.

DETAILED DESCRIPTION OF EMBODIMENTS OF THE DISCLOSED TECHNOLOGY

A gun holder is situated within a box spring beneath a mattress. The mattress itself has an opening therein matching the size of the opening into the gun holder and extending through the mattress. One can then lie on one's bed and near one's arm, reach downward into the box spring or other mattress support, and grab the gun without having to move the majority of one's body from the position in which one was sleeping on the bed.

Embodiments of the disclosed technology will become clearer in view of the following description of the drawings.

Figure 1:
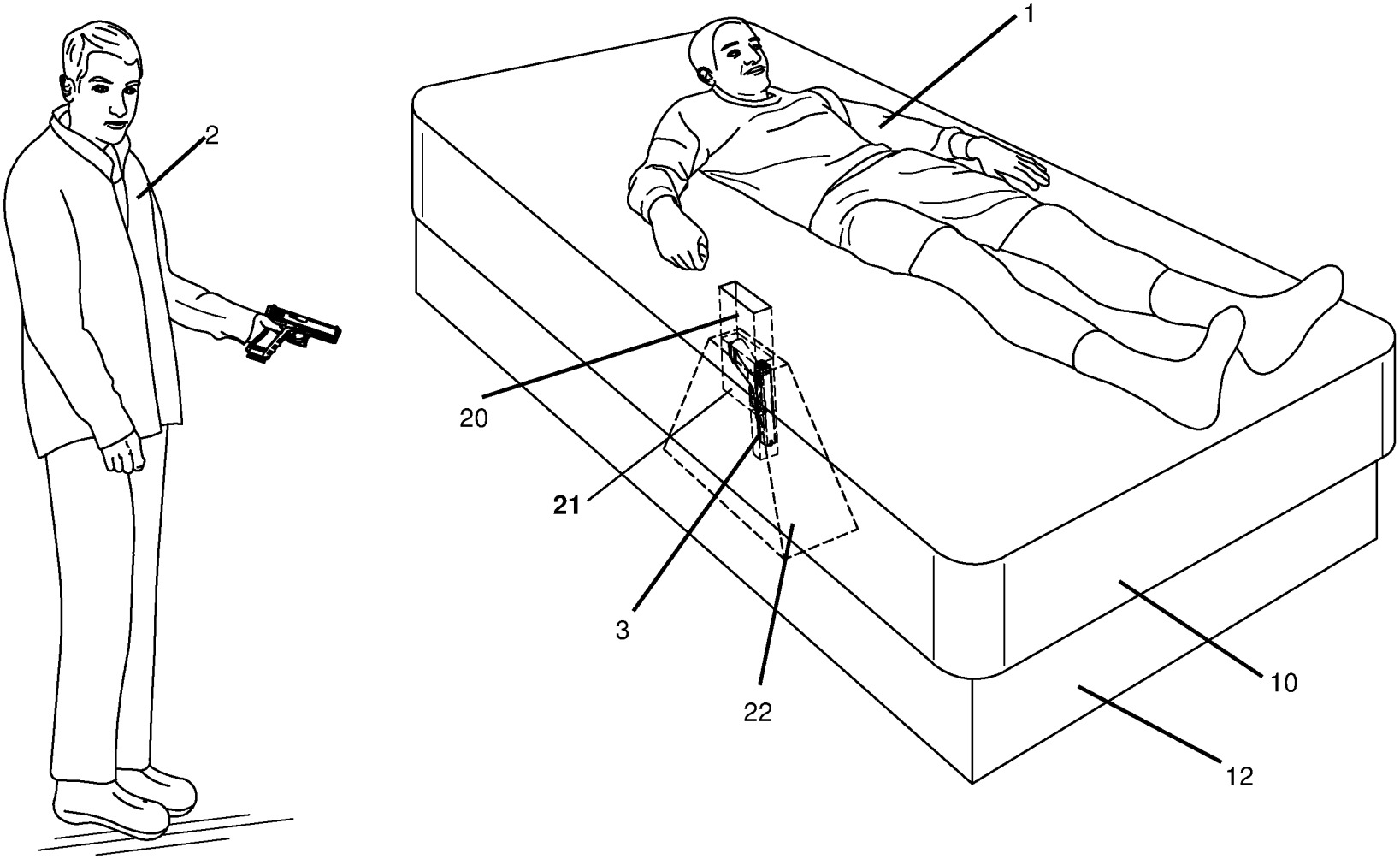
FIG. 1 shows a perspective view of a person lying in bed while an intruder comes in, in embodiments of the disclosed technology.

FIG. 1 shows a perspective view of a person lying in bed, while an intruder comes in, in an embodiment of the disclosed technology. A person 1 is lying in his bed, sleeping or otherwise, when in walks person 2 ready to do harm to person 1. Person 1 lies on a top side of a mattress 10 which is, in turn, situated on a box spring 12. The mattress 10 can have a bullet-proof layer at the top or bottom, so that it can be used as a shield, if need be. Person 1 has the ability to defend himself beneath his sheet, because, unknown to person 2, there is a portal 20 extending through the mattress 10 into a portal 21 in the box spring, where a gun 3 is present within the portal 21 of the box spring. Person 2 or someone else previously placed the gun there and hid it from view.

Figure 2:
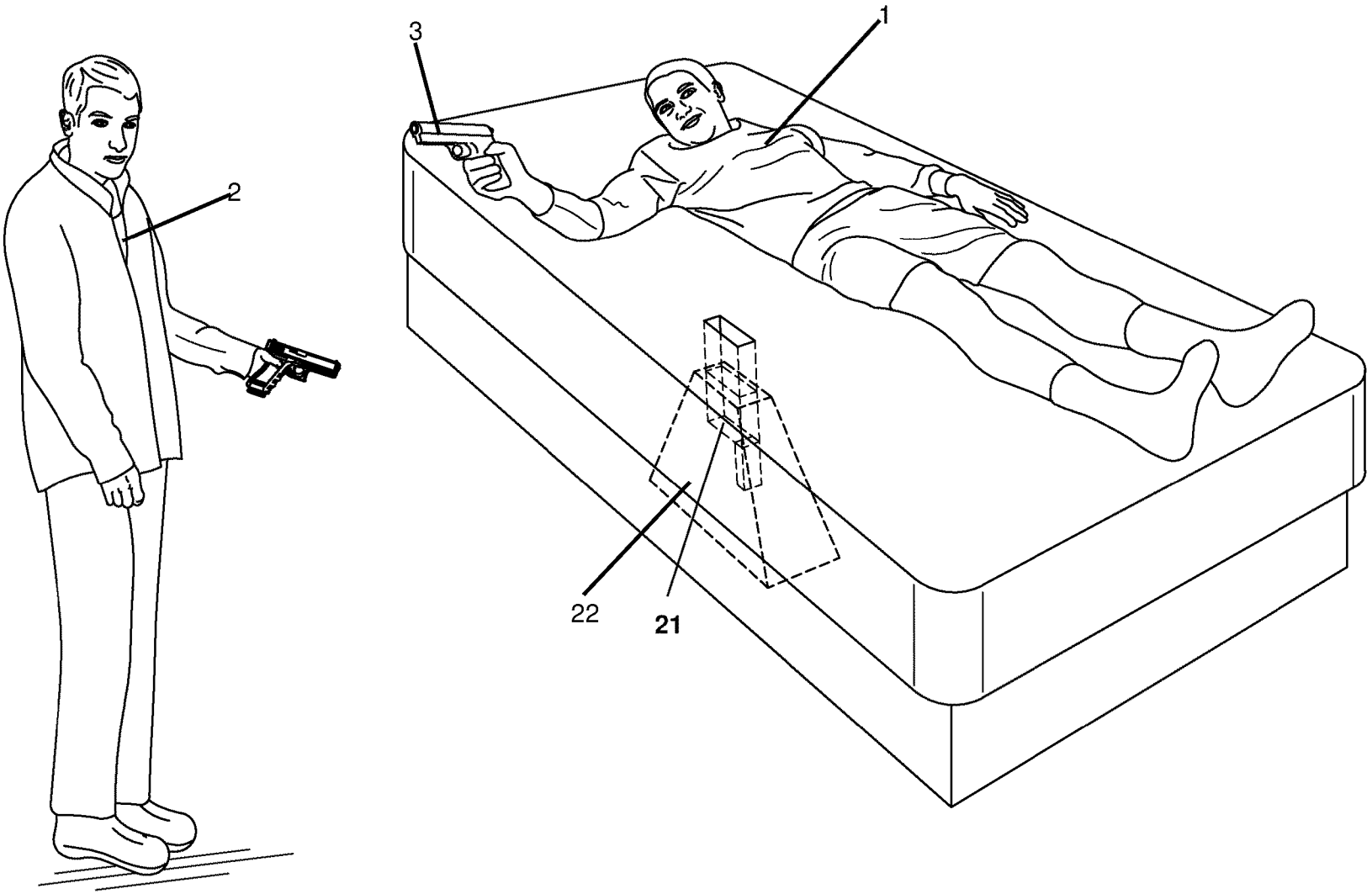
FIG. 2 shows the scene of FIG. 1 after the person lying in bed grabs his/her own gun, in an embodiment of the disclosed technology.

FIG. 2 shows the scene of FIG. 1 after the person lying in bed has grabbed his/her own gun, in an embodiment of the disclosed technology. Continuing our scenario from FIG. 1, person 1 reaches for the gun held in the portal 21 in the box spring, pulls it out, and now can shoot person 2, or at least point the weapon at the person. The gun can be pulled out from the portal 21 under a sheet (not shown).

Figure 3:
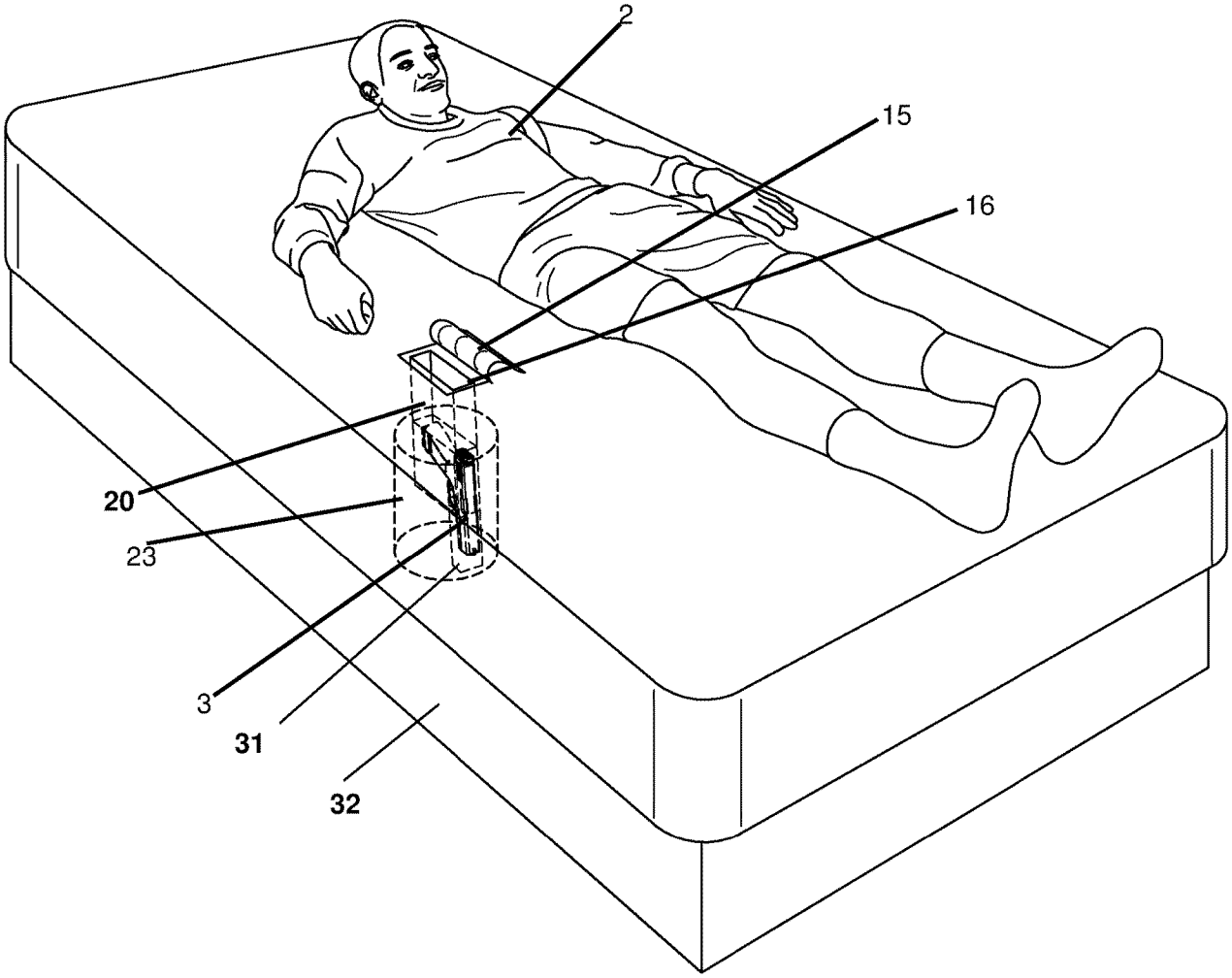
FIG. 3 shows a mattress with flap in the sheet that can be opened, revealing a hidden gun compartment, in an embodiment of the disclosed technology.

FIG. 3 shows a mattress with openable flap in the sheet revealing a hidden gun compartment, in an embodiment of the disclosed technology. Here, the flap 15 closes on to the top side 16 of a portal 20 of the mattress 10. This top side of the portal is adjacent to/opens to the top side of the mattress 10, and the flap 15 can be part of the mattress or a bed sheet covering the mattress. The flap 15 can be attached on one side, while detached or openable on three sides, such as is shown in FIG. 3. Note also that a cylindrical chamber 23 is shown, surrounding a portal 31 in a mattress support 32 disposed beneath the mattress, where the gun is held in this embodiment. The gun holder/chamber 23 has equally-sized top and bottom sides and straight walls extending from the top to the bottom. In other embodiments, such as shown in FIG. 2, a top portion of the portal in the mattress support 32 can be smaller than a bottom portion of portal and can be defined based on their relative sizes, with the top portion being smaller. Portal 20 in the mattress can also line up with portal 31 and/or with chamber 23 in the mattress support 32. The mattress support can be a box spring.

Figure 4:
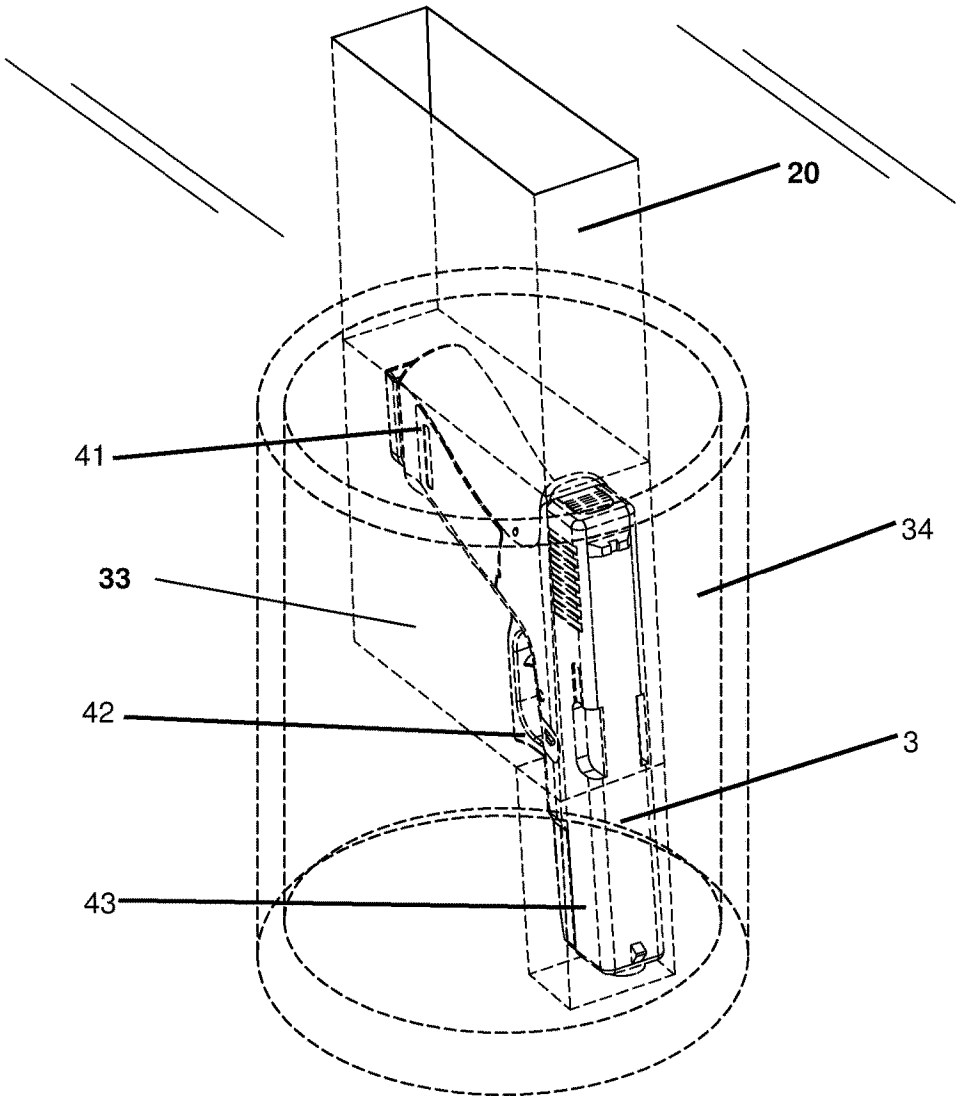
FIG. 4 shows a perspective view of a gun compartment used in embodiments of the disclosed technology.

FIG. 4 shows a perspective view of a gun compartment used in embodiments of the disclosed technology. A portion shown represents the portal 20 within the mattress 10, and another portion represents portal 34 within the mattress support. Here the gun compartment or gun holder 33 within portal 34 has a top portion which is narrower (rectangular region, and) which opens to the exact size of the portal 20 of the mattress on the left, right, front, and back sides (relative to the sides of the bed, as the terminology is used throughout this disclosure). A bottom portion of the gun holder 33 is narrower and defined-thereby. The bottom portion holds a slide or barrel 43 of the gun, whereas the lowest side of the top portion abuts the trigger guard 42 of the gun, while the magazine 41 of the gun is too wide/angled/long to fit within the bottom portion of the holder 33. In this manner, the barrel is forced to point downwards away from anyone lying on top of the bed Thus, in case of accidental discharge in bed, the bullet will go downwards and not enter into anyone in the bed.

Figure 5:
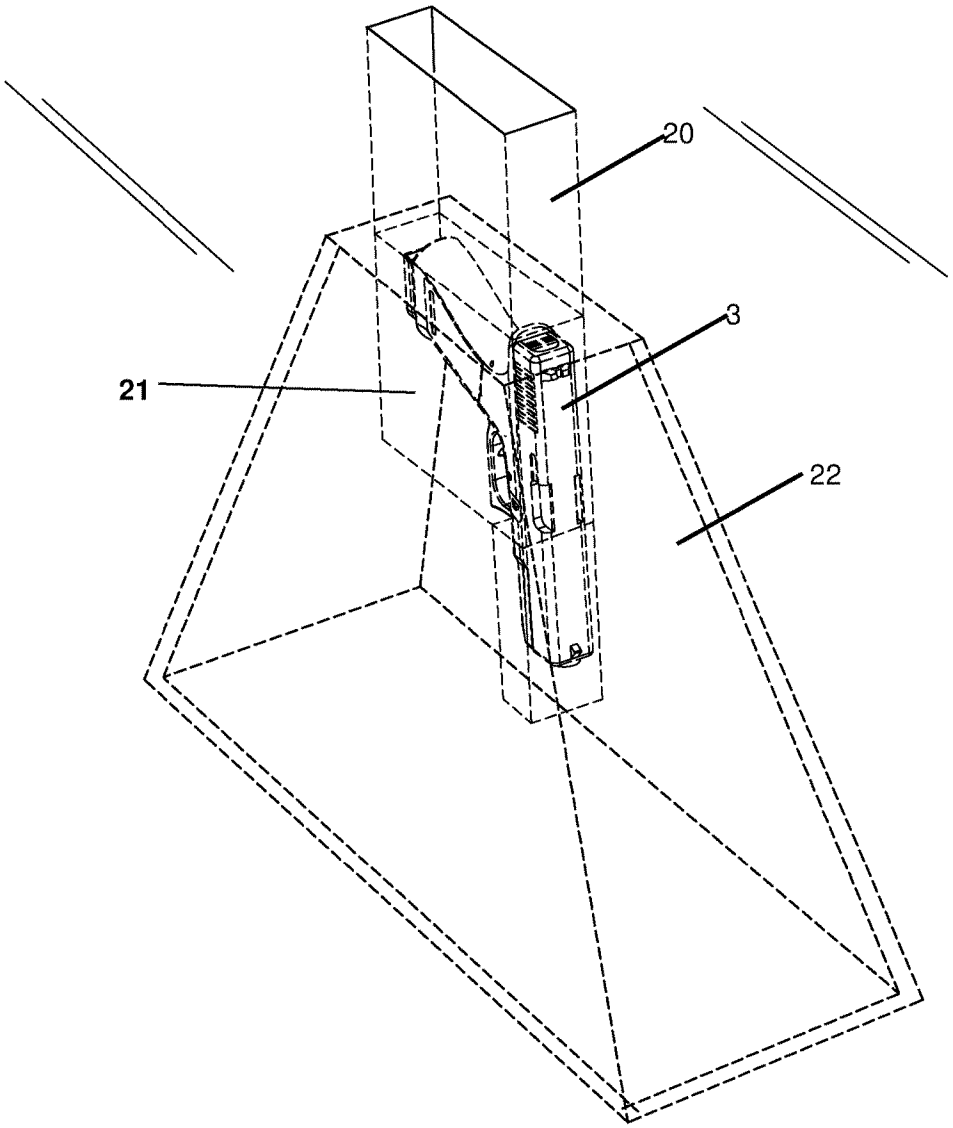
FIG. 5 shows a perspective view of a second gun compartment used in embodiments of the disclosed technology.

FIG. 5 shows a perspective view of a second gun compartment used in embodiments of the disclosed technology. In this version, a larger bullet trap 22 surrounds of the gun holder 21 is used. Here, it the bullet trap 22 is trapezoidal, having curved sides and more distance to catch a bullet misfired there-in, where the bullet can then bounce around without causing harm.

Figure 6:
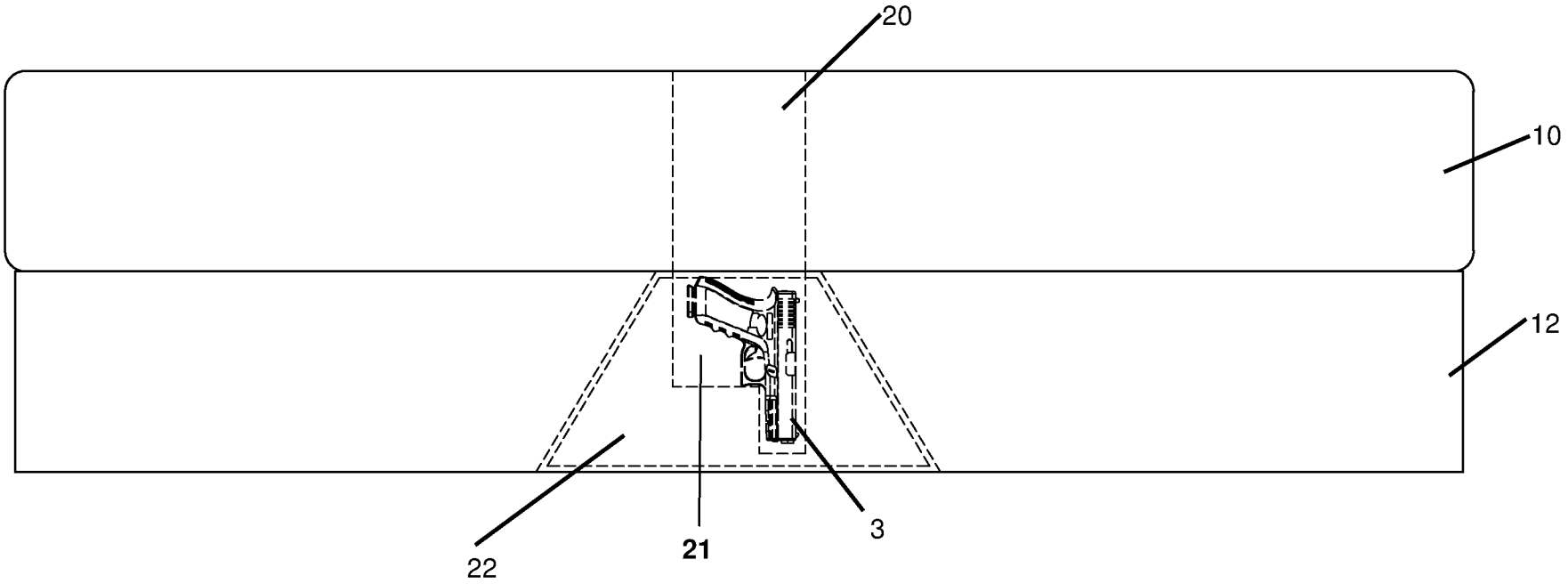
FIG. 6 shows a side elevation view of a mattress and box spring with gun compartment, used in embodiments of the disclosed technology.

FIG. 6 shows a side elevation view of a mattress and box spring with gun compartment used in embodiments of the disclosed technology. In this view, it can readily be seen that the mattress portal 20 extends downward through the mattress 10 and joins a portal 21 in the box spring 12, the portal 21 having the same length and width as the portal 20 in the mattress 10. That is, the left, right, front, and back sides align. The gun 3 points downwards into a lower portion of portal 21, which can also serve as bullet trap 22.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A combination mattress and box spring comprising:

a unitary mattress with top, bottom, left, right, front, and back sides;

a mattress support with top, bottom, left, right, front, and back sides situated beneath said unitary mattress;

a mattress portal in said unitary mattress extending from said top side to said bottom side of said unitary mattress, said mattress portal having a left, right, front, and back side;

a support portal in said mattress support, said support portal having a top side lined up with, and having equal dimensions to, said mattress portal, wherein said support portal has a top section and a lower section, said top section terminating at said top side of said support portal, said top section being wider than said lower section;

wherein said support portal is surrounded by a bullet trap, disposed in said mattress support, which bullet trap is constructed in a manner sufficient to retain a bullet fired from a handgun situated in said support portal.

2. The combination mattress and box spring of claim 1, wherein said mattress portal is of equal width from said top side to said bottom side of said mattress.

3. The combination mattress and box spring of claim 2, where both said mattress portal and said support portal have left, right, front, and back sides.

4. The combination mattress and box spring of claim 1, wherein said bullet trap has a bottom side and a top side, narrower than said bottom side.

5. The combination mattress and box spring of claim 1, wherein said lower section of said support portal is adapted to hold a slide of a gun and is smaller in width than a magazine of said gun.

6. The combination mattress and box spring of claim 1, wherein a trigger guard of said gun rests against a top edge of said lower section of said support portal.

7. The combination mattress and box spring of claim 1, further comprising a sheet covering at least said top side of said unitary mattress with a flap in said sheet opening into said mattress portal.

8. A gun holder situated within a mattress support beneath a unitary mattress, the mattress support having a substantially equal width and length as the unitary mattress, the gun holder comprising:

a mattress portal, extending through said the mattress and having four sides; and a support portal extending through at least part of the depth of the mattress support and having four sides, said support portal being substantially aligned with said mattress portal on said four sides of each of said mattress portal and of said support portal;

further comprising a bullet trap surrounding a bottom side of said gun holder and adapted to stop a bullet from penetrating there-through when fired from a handgun held in said gun holder.

9. The gun holder of claim 8, wherein said gun holder support portal has a wider upper portion and narrower lower portion.

10. The gun holder of claim 9, having a handgun situated therein, such that a magazine of said handgun fits only in said wider upper portion to the exclusion of said narrower lower portion.

11. The gun holder of claim 10, wherein said unitary mattress is covered by a sheet with a flap opening into a top side of said unitary mattress.

12. The gun holder of claim 11, wherein said flap opens on three sides of said gun holder.

* * * * *